US007408521B2

(12) United States Patent
Smith et al.

(10) Patent No.: US 7,408,521 B2
(45) Date of Patent: Aug. 5, 2008

(54) LOW PROFILE BICONE ANTENNA

(75) Inventors: James Lesley Smith, Garland, TX (US); Nicholas Savino, Grapevine, TX (US)

(73) Assignee: Innerwireless, Inc., Richardson, TX (US)

( * ) Notice: Subject to any disclaimer, the term of this patent is extended or adjusted under 35 U.S.C. 154(b) by 302 days.

(21) Appl. No.: 11/402,707

(22) Filed: Apr. 12, 2006

(65) Prior Publication Data

US 2007/0241980 A1 Oct. 18, 2007

(51) Int. Cl.
*H01Q 13/00* (2006.01)
*H01Q 1/36* (2006.01)

(52) U.S. Cl. ..... 343/773; 343/774; 343/908

(58) Field of Classification Search ..... 343/725, 343/773, 774, 810–816, 829, 830, 908
See application file for complete search history.

(56) References Cited

U.S. PATENT DOCUMENTS

| | | | | |
|---|---|---|---|---|
| 2,501,020 | A | 3/1950 | Barnes | |
| 3,656,166 | A | 4/1972 | Klopach et al. | |
| 4,686,536 | A | 8/1987 | Allcock | |
| 4,814,777 | A | 3/1989 | Monser | |
| 5,534,880 | A * | 7/1996 | Button et al. | 343/774 |
| 6,268,834 | B1 * | 7/2001 | Josypenko | 343/773 |
| 6,369,778 | B1 | 4/2002 | Dockery | |
| 6,667,721 | B1 | 12/2003 | Simonds | |
| 7,221,326 | B2 * | 5/2007 | Ida et al. | 343/773 |
| 2003/0107524 | A1 * | 6/2003 | Hart | 343/860 |
| 2003/0210207 | A1 | 11/2003 | Suh et al. | |
| 2006/0022885 | A1 | 2/2006 | Ida et al. | |

FOREIGN PATENT DOCUMENTS

| | | | |
|---|---|---|---|
| CN | 1862878 | A | 11/2006 |
| EP | 1189305 | A2 | 3/2002 |
| EP | 1189305 | A3 | 8/2003 |
| EP | 1523064 | A1 | 4/2005 |
| FR | 2754109 | A1 | 8/2007 |
| GB | 2165097 | A | 4/1986 |
| JP | P2003-198236 | A | 7/2003 |

(Continued)

OTHER PUBLICATIONS

European Partial Search Report, Application No. 06250377.6 issued May 22, 2006.

(Continued)

*Primary Examiner*—Shih-Chao Chen
(74) *Attorney, Agent, or Firm*—Haynes and Boone LLP; Dave R. Hofman

(57) ABSTRACT

An antenna that includes, in at least one embodiment, first and second radiating elements each having a substantially conical radiating surface. Each radiating surface may be substantially linearly conical or nonlinearly conical. The radiating surfaces are substantially aligned coaxially, and the radiating elements are positioned on opposing sides of a signal launching region, extending in opposing directions from the signal launching region. A signal feed extends through the first radiating element, thereby positioning a signal launch point between the first and second radiating elements in the signal launching region proximate vertices of the first and second radiating surfaces. The first and second radiating elements have first and second included angles, respectively, that are each no less than about 40 degrees.

24 Claims, 11 Drawing Sheets

FOREIGN PATENT DOCUMENTS

WO 2004/010531 A1 1/2004

OTHER PUBLICATIONS

European Extended Search Report, Application No. 06250377.6 issued Aug. 28, 2006.

PCT International Search Report and Written Opinion, Application No. PCT/US2007/062844 issued Jun. 21, 2007.

Lee, Jae W., et al., "The Wideband Characteristics of Plate Antenna with Elliptical Cross Section." Electromagnetic Compatibility, May 11, 2003, vol. 1, pp. 154-157.

* cited by examiner

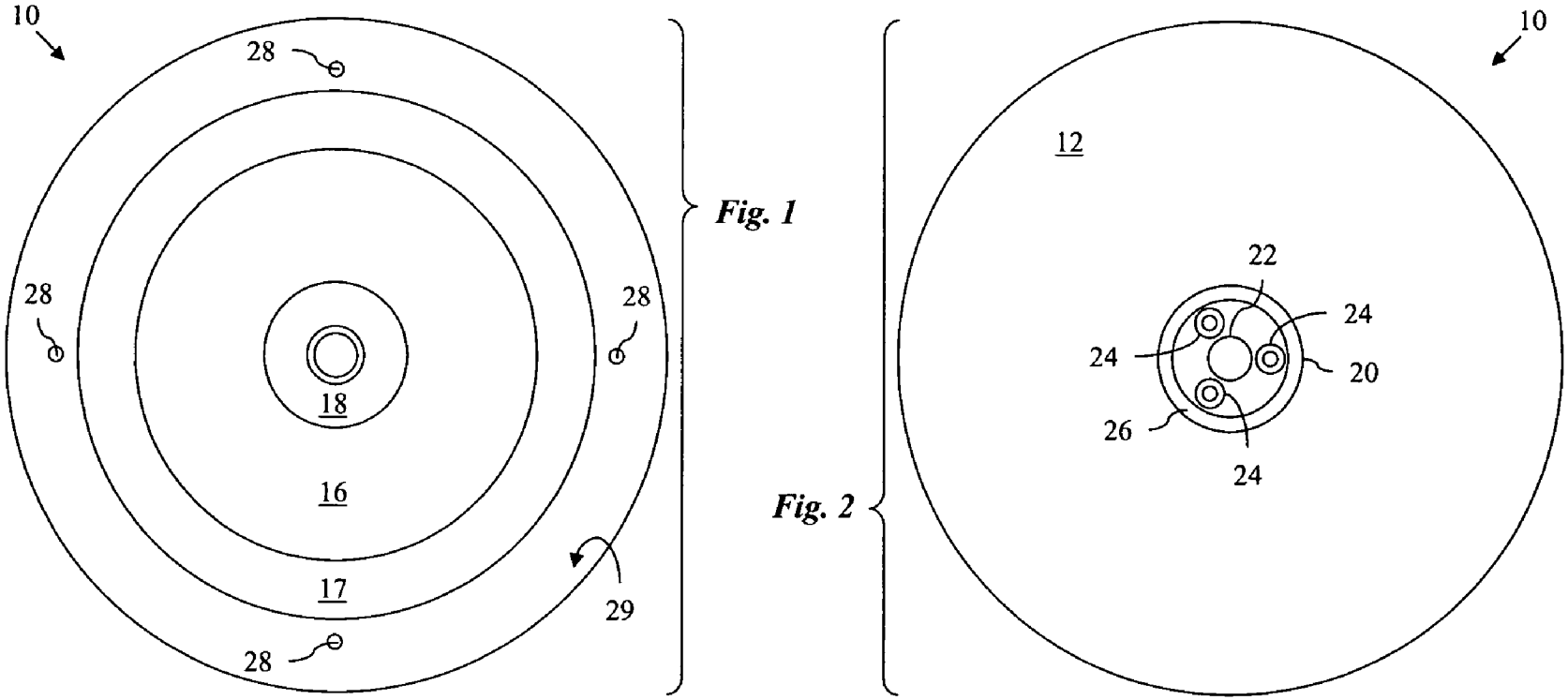
Fig. 1
Fig. 2
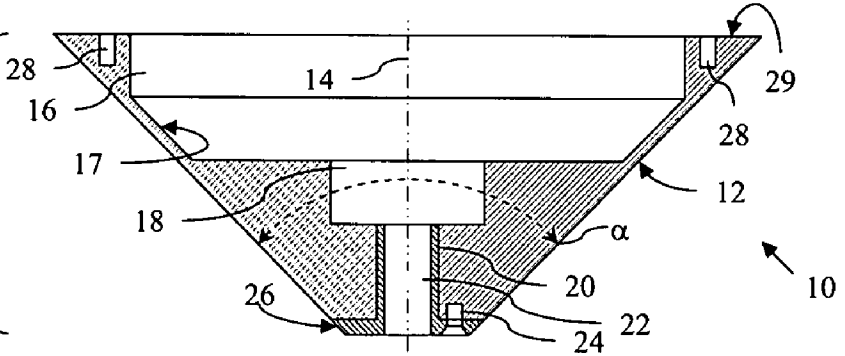
Fig. 3

LOW PROFILE BICONE ANTENNA

BACKGROUND

The rapid adoption of multiple wireless services operating at widely dispersed frequencies presents a challenge for conventional antenna designs, which typically focus on relatively narrowband characteristics in single, dual, or triple band configurations. Such designs are increasingly difficult to implement as existing frequency bands are expanded and new bands are made available to deliver new services.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 1 is a top view of at least a portion of an apparatus demonstrating aspects of the present disclosure.

FIG. 2 is a bottom view of at least a portion of the apparatus shown in FIG. 1.

FIG. 3 is a sectional view of at least a portion of the apparatus shown in FIG. 1.

DETAILED DESCRIPTION

Figure 4:
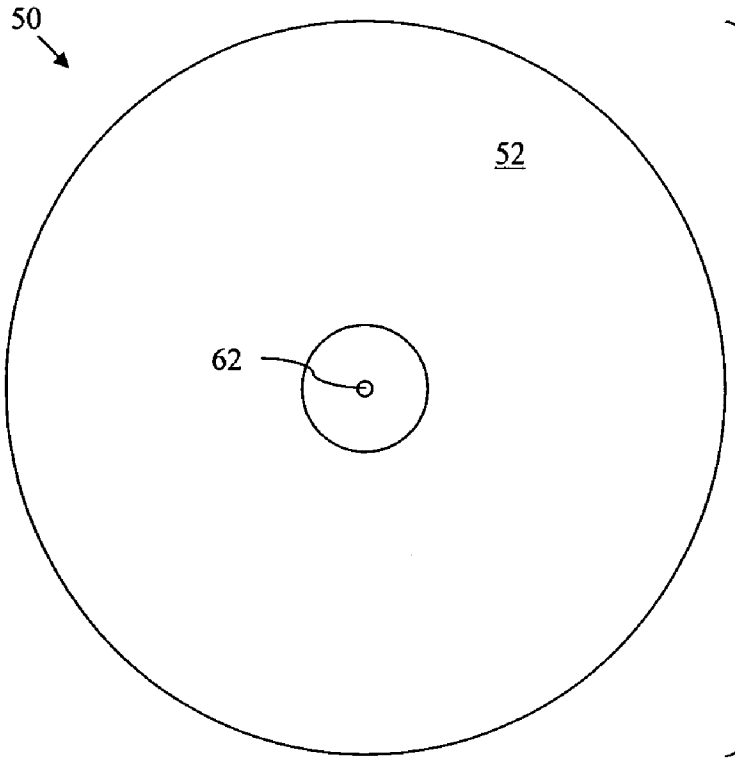
FIG. 4 is a top view of at least a portion of an apparatus demonstrating aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIGS. 1-3, collectively, illustrated are top, bottom, and sectional views, respectively, of a radiating element 10 according to aspects of the present disclosure. The radiating element 10 may comprise zinc and/or other metals, or metal-coated non-metallic materials (e.g., plastic), and may be formed by machining, casting, molding, and/or other manufacturing processes.

A radiating surface 12 of the radiating element 10 may be substantially conical. For example, the substantially conical shape of the radiating surface 12 may be substantially linearly conical, such that any curvature of the radiating surface 12 may only be in relation to the central axis 14 of the radiating element 10. The radiating surface 12 has an included angle $\alpha$ of about 84 degrees. However, other values for the included angle $\alpha$ are also within the scope of the present disclosure and may be applicable to the radiating surface 12. For example, the included angle $\alpha$ of the radiating surface 12 may range between about 75 degrees and about 120 degrees, or possibly between about 75 degrees and about 150 degrees, within the scope of the present disclosure. Although other values of the included angle $\alpha$ may also be employed within the scope of the present disclosure, most embodiments disclosed herein will have an included angle $\alpha$ of no less than about 75 degrees. Consequently, the radiating element 10 may have a lower profile compared to conventional bicone antenna radiating elements which generally employ an included angle $\alpha$ ranging between about 20 degrees and about 60 degrees.

A substantial portion of the radiating element 10 may be hollowed, such as to reduce weight or material costs, among other possible reasons. For example, the radiating element 10 shown in FIGS. 1-3 includes a recess 16 having a chamfered bottom 17. Of course, shapes other than that shown in FIGS. 1-3 may alternatively be employed for the recess 16. The radiating element 10 may also include additional internal features, such as the smaller recess 18 depicted in FIGS. 1 and 3 which may be employed as an interface to an electrical feedthrough connector, for example.

The radiating element 10 may also include, or be coupled to, a member 20 which, as in the embodiment depicted in FIGS. 1-3, may resemble a flange. A through-hole 22 may extend through the central portion of the member 20 and, thus, may be substantially coaxial with the recess 16, the recess 18, and/or other features of the radiating element 10. The member 20 may be soldered or otherwise adhered to the radiating element 10 or, as shown best in FIGS. 2 and 3, may be coupled to the radiating element 10 by one or more mechanical fasteners 24, such as rivets or threaded fasteners. The member 20 may have a tapered or chamfered outer profile 26 that may continue or otherwise substantially conform to the profile of the radiating surface 12 of the radiating element 10. Alternatively, the outer edge 26 of the member 20 may be recessed within the radiating surface 12 of the radiating element 10.

The radiating element 10 may also include one or more recesses 28 in a substantially planar surface for, by example, attaching the radiating element 10 to another component. The surface 29 in which the one or more recesses 28 are may at least partially define the perimeter of the radiating element 10, as in the example shown in FIGS. 1 and 3, or may be an interior surface. Each recess 28 may have smooth sidewalls or otherwise be configured for engagement with a rivet or other fastener, or the sidewalls may be at least partially threaded for engagement with a threaded fastener. Of course, means other than the one or more recesses 28 may be employed to couple the radiating element 10 to another component.

Figure 5:
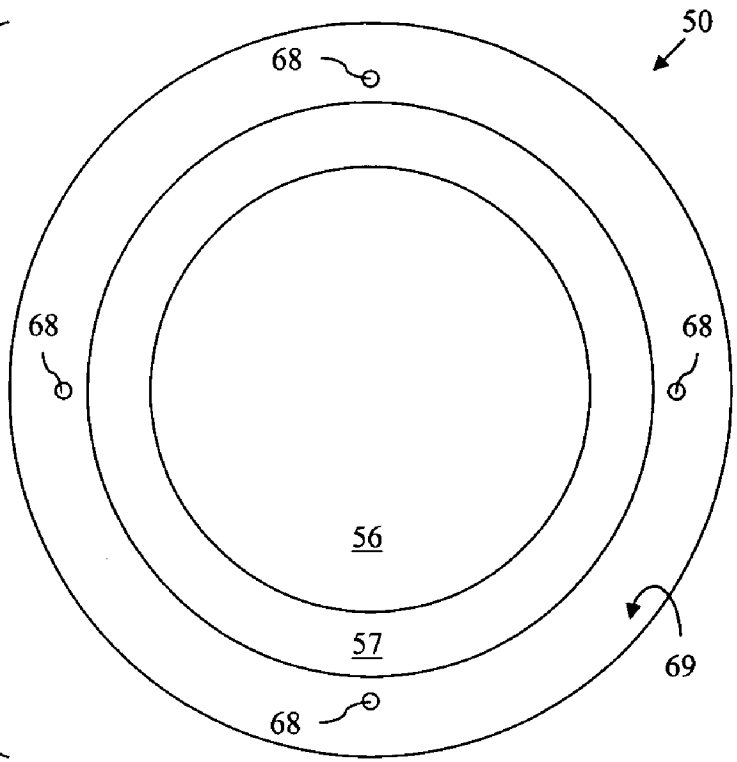
FIG. 5 is a bottom view of at least a portion of the apparatus shown in FIG. 4.
Figure 6:
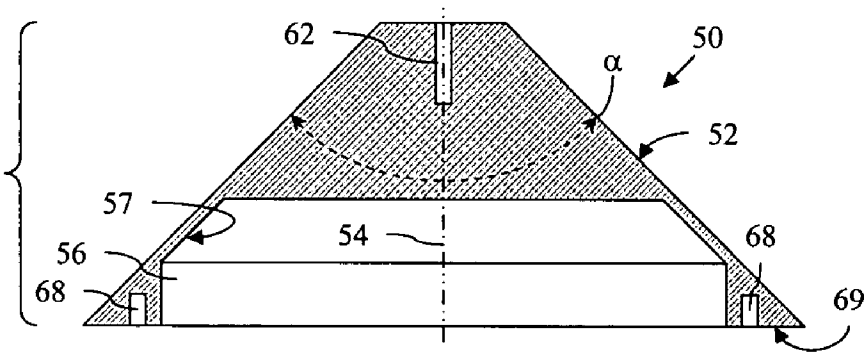
FIG. 6 is a sectional view of at least a portion of the apparatus shown in FIG. 4.

Referring to FIGS. 4-6, collectively, illustrated are top, bottom, and sectional views, respectively, of a radiating element 50 according to aspects of the present disclosure. The radiating element 50 may comprise zinc and/or other metals, or metal-coated non-metallic materials (e.g., plastic), and may be formed by machining, casting, molding, and/or other manufacturing processes. The radiating element 50 may be substantially similar in manufacture and/or composition relative to the radiating element 10.

A radiating surface 52 of the radiating element 50 may be substantially conical. For example, the substantially conical shape of the radiating surface 52 may be substantially linearly conical, such that any curvature of the radiating surface 52 may only be in relation to the central axis 54 of the radiating element 50. The radiating surface 52 has an included angle $\alpha$ of about 84 degrees. However, other values for the included angle $\alpha$ are also within the scope of the present disclosure and may be applicable to the radiating surface 52. For example, the included angle $\alpha$ of the radiating surface 52 may range between about 75 degrees and about 120 degrees, or possibly between about 75 degrees and about 150 degrees, within the scope of the present disclosure. Although other values of the included angle $\alpha$ may also be employed within the scope of the present disclosure, most embodiments disclosed herein will have an included angle $\alpha$ of no less than about 75 degrees. Consequently, the radiating element 50 may have a lower profile compared to conventional bicone antenna radiating elements which generally employ an included angle $\alpha$ ranging between about 20 degrees and about 60 degrees. The radiating element 50 may have an included angle $\alpha$ that is substantially similar to the included angle $\alpha$ of the radiating element 10.

A substantial portion of the radiating element 50 may be hollowed, such as to reduce weight or material costs, among other possible reasons. For example, the radiating element 50 shown in FIGS. 4-6 includes a recess 56 having a chamfered bottom 57. Of course, shapes other than that shown in FIGS. 4-6 may alternatively be employed for the recess 56. The radiating element 50 may also include additional internal features, such as additional recesses, apertures, or other features.

The radiating element 50 may also include an aperture 62 extending at least partially into the radiating element 50. The aperture 62 may have smooth sidewalls or otherwise be configured for engagement with a rivet or other fasteners, or the sidewalls may be at least partially threaded for engagement with a threaded fastener.

The radiating element 50 may also include one or more recesses 68 in a substantially planar surface for, by example, attaching the radiating element 50 to another component. The surface 69 in which the one or more recesses 68 are may at least partially define the perimeter of the radiating element 50, as in the example shown in FIGS. 5 and 6, or may be an interior surface. Each recess 68 may have smooth sidewalls or otherwise be configured for engagement with a rivet or other fastener, or the sidewalls may be at least partially threaded for engagement with a threaded fastener. Of course, means other than the one or more recesses 68 may be employed to couple the radiating element 50 to another component.

Figure 7:
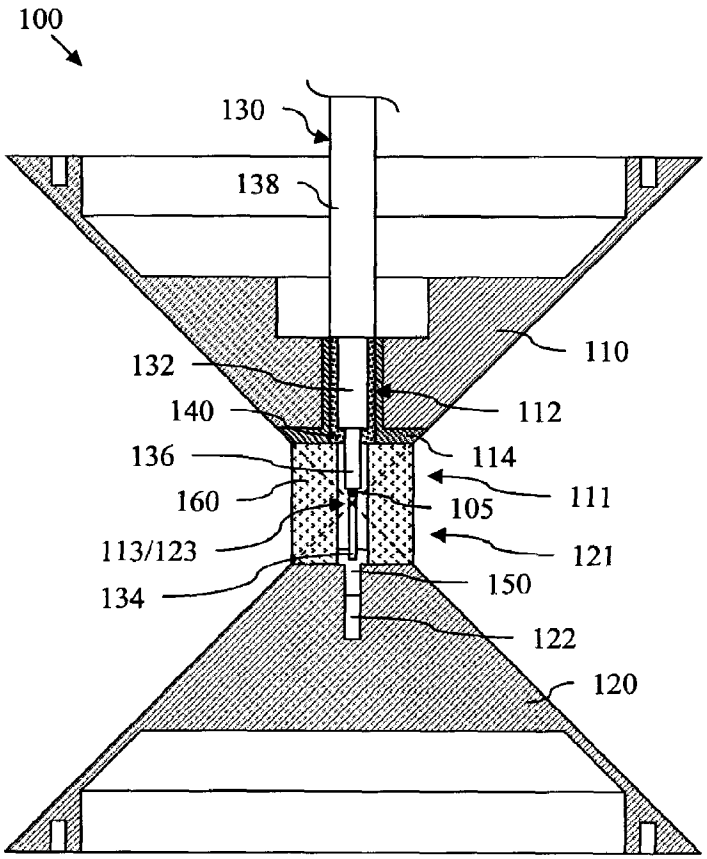
FIG. 7 is a sectional view of at least a portion of an apparatus demonstrating aspects of the present disclosure.

Referring to FIG. 7, illustrated is a sectional view of a radiating apparatus 100 demonstrating aspects of the present disclosure. The apparatus 100 includes a radiating element 110 that is substantially similar to the radiating element 10 shown in FIGS. 1-3. The apparatus 100 also includes a radiating element 120 that is substantially similar to the radiating element 50 shown in FIGS. 4-6. The apparatus 100 may include or be included in a wireless network component, or may itself be a wireless network component.

The apparatus 100 also includes a signal feed 130 extending through a through-hole 112 of a flange 114 or other component of the radiating element 110, or of the radiating element 110 itself. The signal feed 130 is coupled at least indirectly to the radiating element 120. The through-hole 112 of the radiating element 110 may be substantially similar to the through-hole 22 shown in FIGS. 1-3. The signal feed 130 may be a coaxial or other type of cable configured for communicating signals to and/or from the radiating elements 110 and/or 120.

For example, the signal feed 130 may include an outer conductor 132 that is electrically coupled at least indirectly to a flange 114 of the radiating element 110, an inner conductor 134 that is electrically coupled at least indirectly to the radiating element 120, and an insulator 136 interposing and electrically isolating the outer and inner conductors 132, 134. The outer conductor 132 may be electrically coupled to the flange 114 of the radiating element 110 by solder 140, other electrically conductive adhesive, or one or more electrical connectors, among other possible means. The flange 114 may be substantially similar to the member 20 shown in FIGS. 1-3. The inner conductor 134 may also be electrically coupled to the radiating element 120 by solder, other electrically conductive adhesive, or one or more electrical connectors, among other possible means. The signal feed 130 may also comprise an additional, exterior insulator 138 electrically isolating the conductors 132, 134 from the radiating element 110 and/or other nearby components of the apparatus 100.

In the example shown in FIG. 7, the apparatus 100 includes a connecting member 150 which is electrically coupled to an end of the inner conductor 134. The connecting member 150 may be electrically and/or mechanically coupled to the radiating element 120, whether directly or indirectly. For example, the connecting member 150 may be or comprise a threaded fastener configured for threaded engagement with a corresponding aperture 122 or other feature of the radiating element 120, such as the aperture 62 shown in FIGS. 4 and 6.

The apparatus 100 may also include a spacer 160 positioned between the radiating elements 110 and 120. The spacer 160 may contact one or both of the radiating element 110 and 120. For example, the length L of the spacer 160 may be configured to fix the separation between the radiating elements 110 and 120 at a predetermined distance. The spacer 160 may have a plastic and/or other non-magnetic composition. For example, the spacer 160 may have a composition that renders the spacer 160 substantially transparent to radio frequency energy ("RF-transparent").

The spacer 160 may provide mechanical robustness to the assembly of the radiating elements 110 and 120. The spacer 160 may also or alternatively be employed to set the separation distance between the radiating elements 110 and 120. The separation distance between the radiating elements 110 and 120 can affect the position of the signal feed launch point 105, among other factors that may influence the position of the launch point 105 and the efficiency of the apparatus 100.

In the example depicted in FIG. 7, the launch point 105 is positioned about equidistant from the small end 111 of the radiating element 110 and the small end 121 of the radiating element 120 (or the protruding end of the connection member 150). However, the launch point 105 may be positioned elsewhere relative to the radiating elements 110 and 120 within the scope of the disclosure. In one example configuration, the launch point 105 is proximate the vertex 113 of the radiating element 110 and/or the vertex 123 of the radiating element 120. The launch point 105 may substantially coincide with the vertices 113, 123 of the radiating elements 110, 120, where the vertices 113, 123 themselves substantially coincide (as in the example shown in FIG. 7). Alternatively, the launch point 105 may be positioned about equidistant or otherwise between the vertices 113, 123 where the vertices 113, 123 do not substantially coincide.

Figure 8:
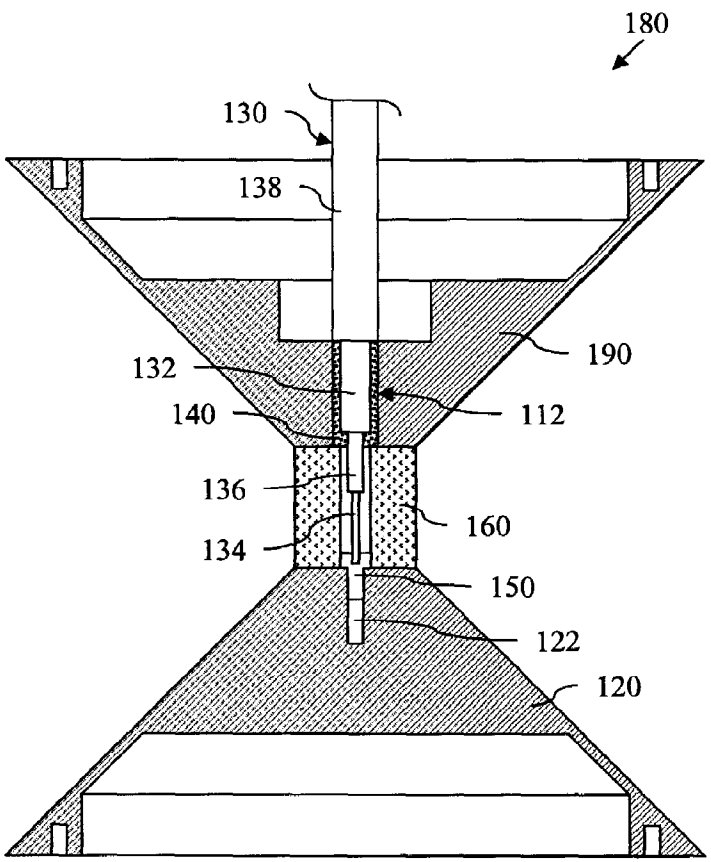
FIG. 8 is a sectional view of at least a portion of an apparatus demonstrating aspects of the present disclosure.

Referring to FIG. 8, illustrated is a sectional view of another example of the apparatus 100 shown in FIG. 7, herein designated by reference numeral 180. The apparatus 180 is substantially similar to the apparatus 100, although possibly with the following exceptions.

For example, the radiating element 190 of the apparatus 180 is substantially similar to the radiating element 110 of the apparatus 100, except that the radiating element 190 of the apparatus 180 does not include the flange 114 employed with the radiating element 110 of the apparatus 100. In contrast, the outer conductor 132 is soldered or otherwise conductively adhered directly to the radiating element 190.

Figure 9A:
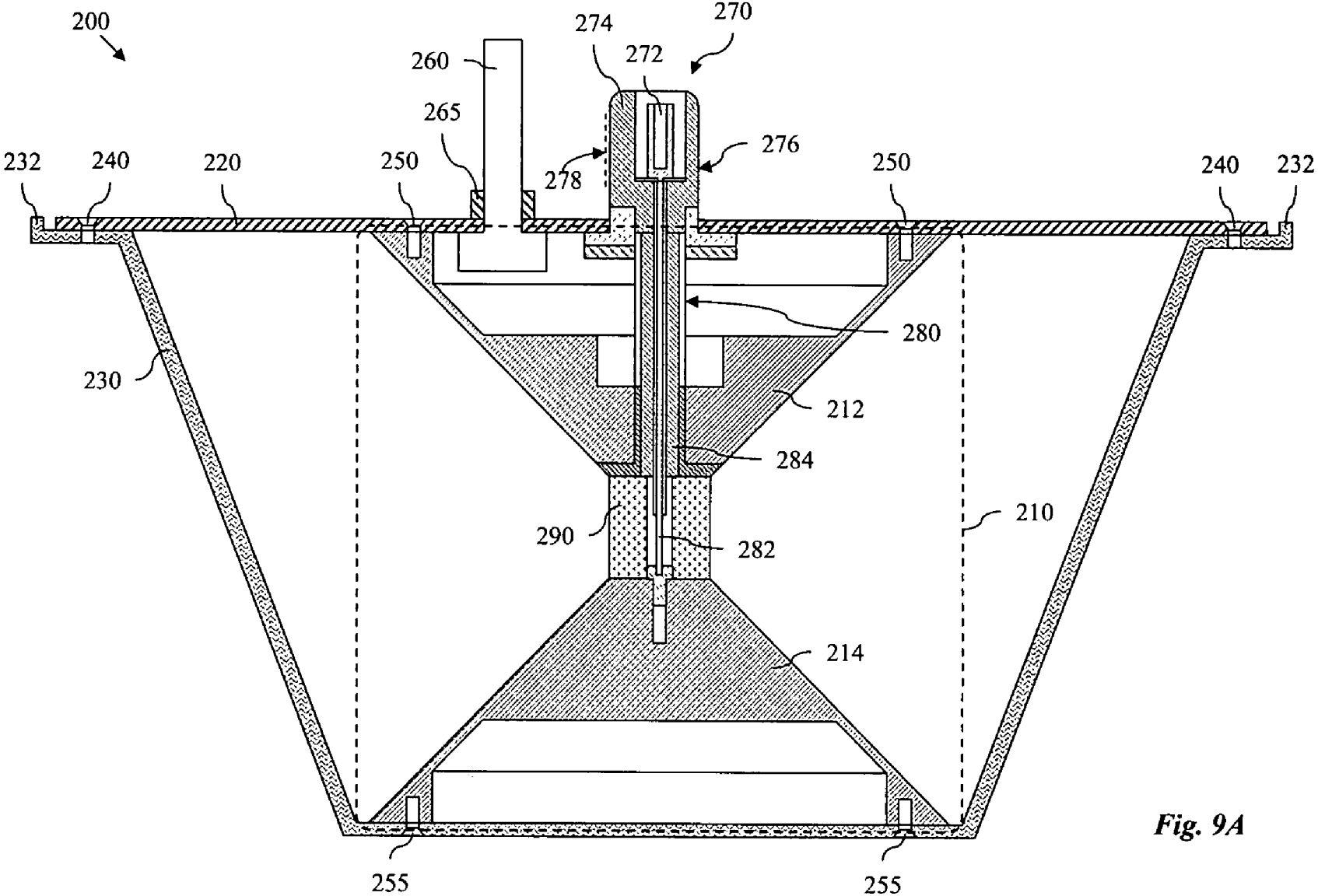
FIG. 9A is a sectional view of at least a portion of an apparatus demonstrating aspects of the present disclosure.
Figure 9B:
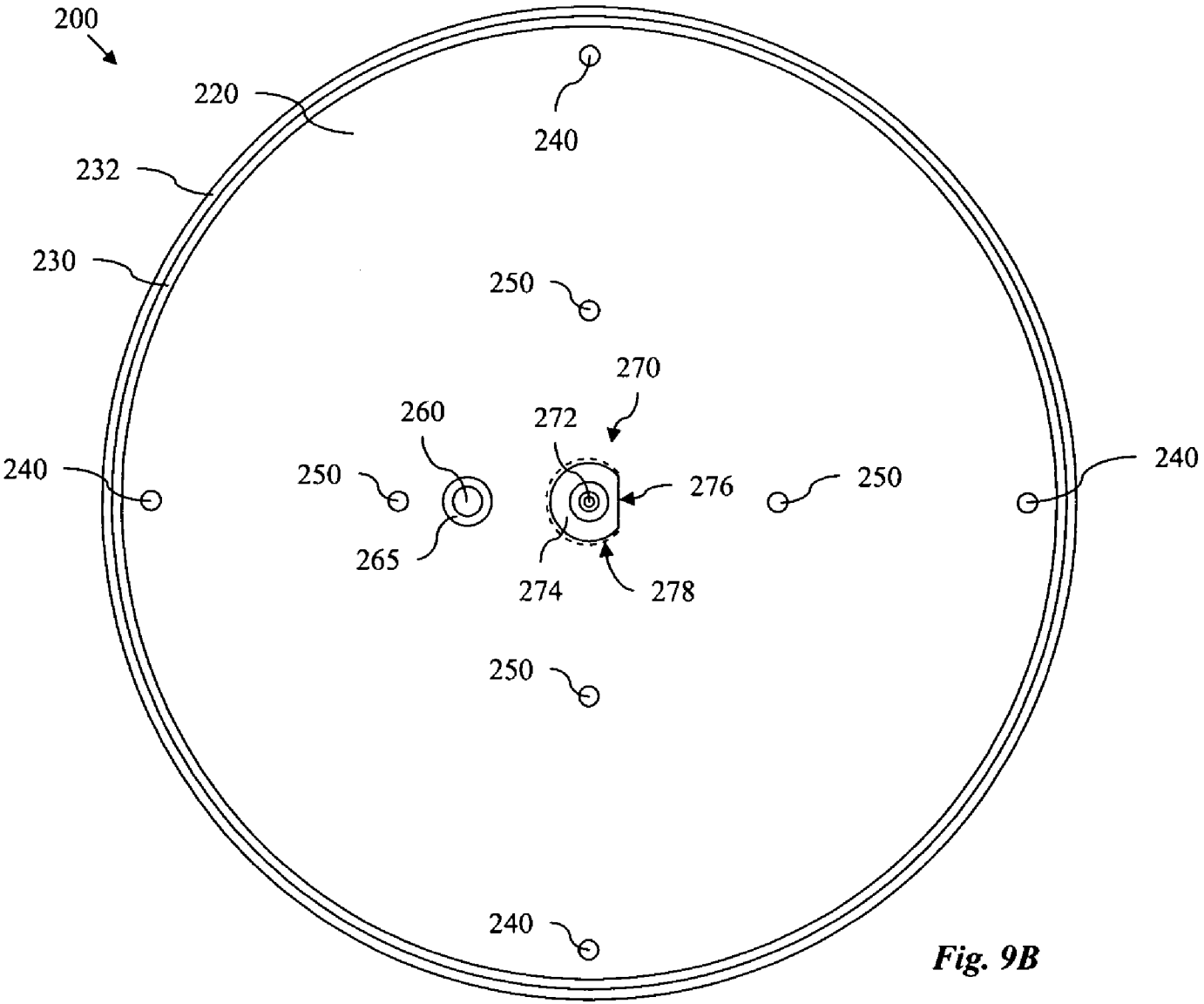
FIG. 9B is a top view of at least a portion of the apparatus shown in FIG. 9A.

Referring to FIGS. 9A and 9B, collectively, illustrated are a section view and a top view of an apparatus 200 demonstrating aspects of the present disclosure. The apparatus 200 may include or be included in a wireless network component, or may itself be a wireless network component.

The apparatus 200 includes a radiating apparatus 210 having a radiating element 212 and an additional radiating element 214. The radiating apparatus 210 is substantially similar to at least one of the radiating elements 100 and 180 shown in FIGS. 7 and 8. For example, the radiating element 212 is substantially similar to the radiating element 10 shown in FIGS. 1-3, and the radiating element 214 is substantially similar to the radiating element 50 shown in FIGS. 4-6.

The apparatus 200 also includes a base 220 and a shroud 230. The base 220 and shroud 230 are configured to partially or substantially enclose the radiating apparatus 210. For example, as in the example depicted in FIGS. 9A and 9B, the base 220 may be a substantially planar member configured to be coupled to the shroud 230, and the shroud 230 may be configured to fit around and/or over the radiating apparatus 210 for mating with the base 220. The outer perimeter of the shroud 230 may have a lip 232 configured to conceal the outer perimeter of the base 220.

The base 220 and the shroud 230 may have a metallic or plastic composition, and may be manufactured by stamping, pressing, machining, casting, and/or other manufacturing processes. The shroud 230 may be coupled with the base 220 by one or more fasteners 240, which may include threaded fasteners, rivets, and/or other mechanical fasteners. Alternatively, or additionally, the shroud 230 may be coupled with the base 220 by welding, adhesive, and/or other means.

The base 220 may also be coupled with the radiating element 212 by one or more fasteners 250, which may include threaded fasteners, rivets, and/or other mechanical fasteners. Alternatively, or additionally, the base 220 may be coupled with the radiating element 212 by welding, adhesive, and/or other means. Similarly, the shroud 30 may also be coupled with the radiating element 214 by one or more fasteners 255, which may include threaded fasteners, rivets, and/or other mechanical fasteners. Alternatively, or additionally, the shroud 230 may be coupled with the radiating element 214 by welding, adhesive, and/or other means.

The base 220 may also include means 260 for coupling the apparatus 200 to support structure corresponding to one of various possible installation scenarios. For example, the coupling means 260 may be or include a threaded fastener (such as a cap screw) extending through the base 220 from within the cavity formed by the base 220 and the shroud 230. In such example, an additional threaded fastener 265 (such as a threaded nut) may be coupled to the threaded fastener 260 to fix the position of the fastener 260 relative to the base 220. However, additional or alternative coupling means 260 may also be employed within the scope of the present disclosure, including means to prevent the rotation of the coupling means 260 relative to the base 220.

The apparatus 200 may also include a feedthrough connector 270 mechanically coupled to the base 220 and electrically coupled to a signal feed 280. The signal feed 280 may be substantially similar to the signal feed 130 shown in FIGS. 7 and 8. For example, the signal feed 280 may be or include a coaxial cable, such that the connector 270 may also be a coaxial connector. Accordingly, in such example, the connector 270 may include internal connection means 272 and external connection means 274. The internal connection means 272 may be configured for engagement with an internal conductor of a coaxial cable, and the external connection means 274 may be configured for engagement with an external conductor of the coaxial cable. The internal connection means 272 may, for example, be configured to receive the internal conductor of the coaxial cable for signal conduction therebetween, and the external connection means 274 may, for example, be configured for threaded engagement with the threaded portion of a standard coaxial connector of the coaxial cable for signal conduction therebetween. Accordingly, the internal connection means 272 may be electrically coupled to an internal conductor 282 of the signal feed 280, which may be coupled at least indirectly to the radiating element 214, and the external connection means 274 may be electrically coupled to an external conductor 284 of the signal feed 280, which may be coupled at least indirectly to the radiating element 212.

The connector 270 may be a "D-connector" having a flat 276 on one side configured to aid in the prevention of rotation of the connector 270 relative to the base 220. Alternatively, the connector 270 may have two such flats 276 collectively configured on opposing sides of the connector 270 for engagement with a standard wrench during assembly of the connector 270 to the base 220. However, as in the example shown in FIGS. 9A and 9B, only one such flat 276 may be included, such that the opposing side of the connector 270 may be threaded (as indicated by dashed line 278).

The apparatus 200 may also include a spacer 290 interposing and, possibly, contacting the radiating elements 212, 214. The spacer 290 may be substantially similar to the spacer 160 shown in FIGS. 7 and 8.

Figure 10:
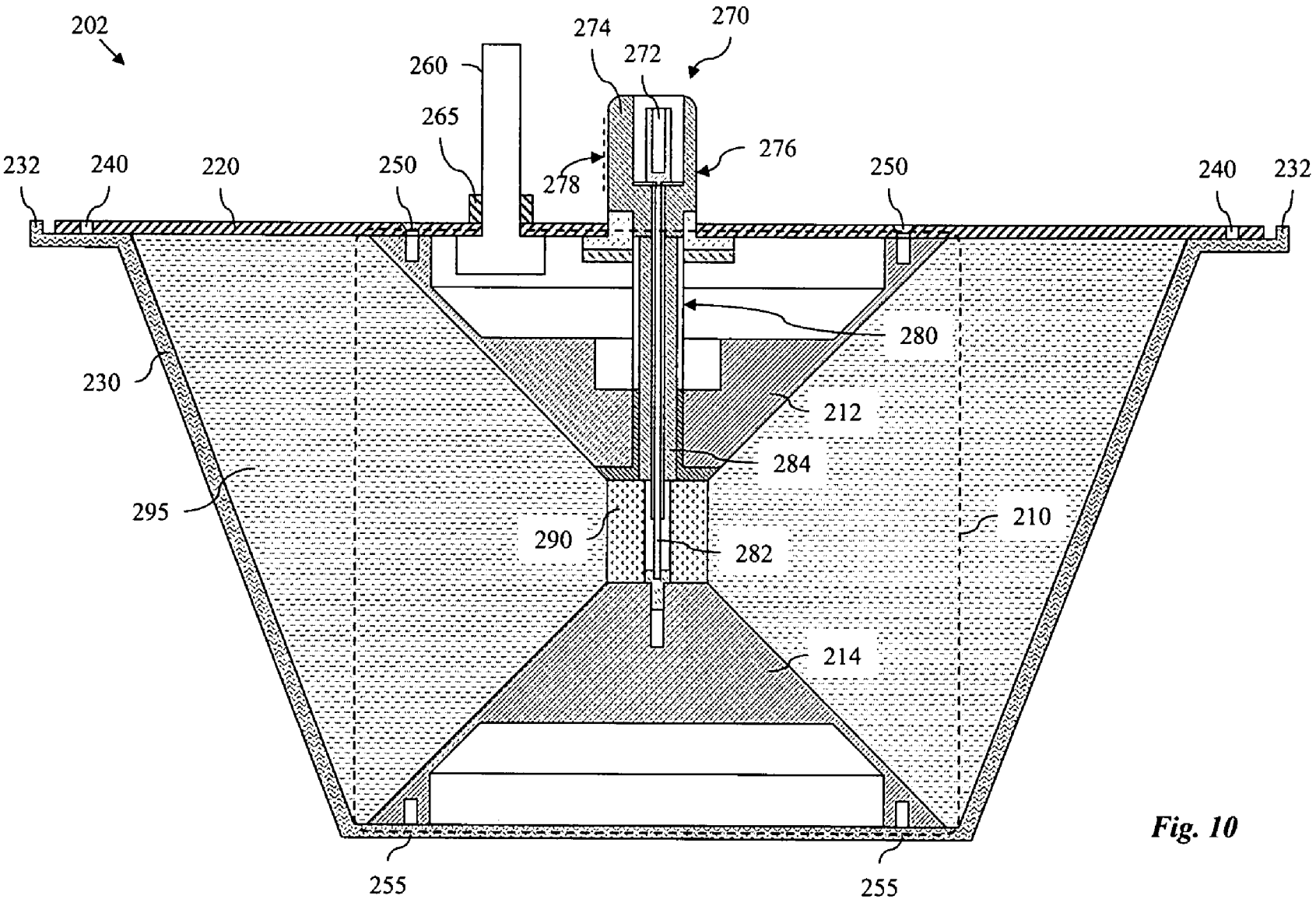
FIG. 10 is a sectional view of at least a portion of an apparatus demonstrating aspects of the present disclosure.

Referring to FIG. 10, illustrated is a sectional view of another example of the apparatus 200 shown in FIGS. 9A and 9B, herein designated by the reference numeral 202. The apparatus 202 may be substantially similar to the apparatus 200 shown in FIGS. 9A and 9B with the following possible exceptions.

The apparatus 202 includes a filler material 295 substantially filling that portion of the cavity defined by the base 220 and the shroud 230 that is not occupied by the apparatus 210. The filler 295 may partially or substantially comprise one or more materials having a variable dielectric constant with variable loss dissipation, such as may be commercially available as powder or powders, liquid or liquids, resin, pack-in-place, or sheet foam (including air or gas), among other forms. The filler 295 may be formed in the cavity between the base 220 and the shroud 230 by one or more of spraying, mixing, pouring, injecting, molding, and machining, among other processes.

Figure 11:
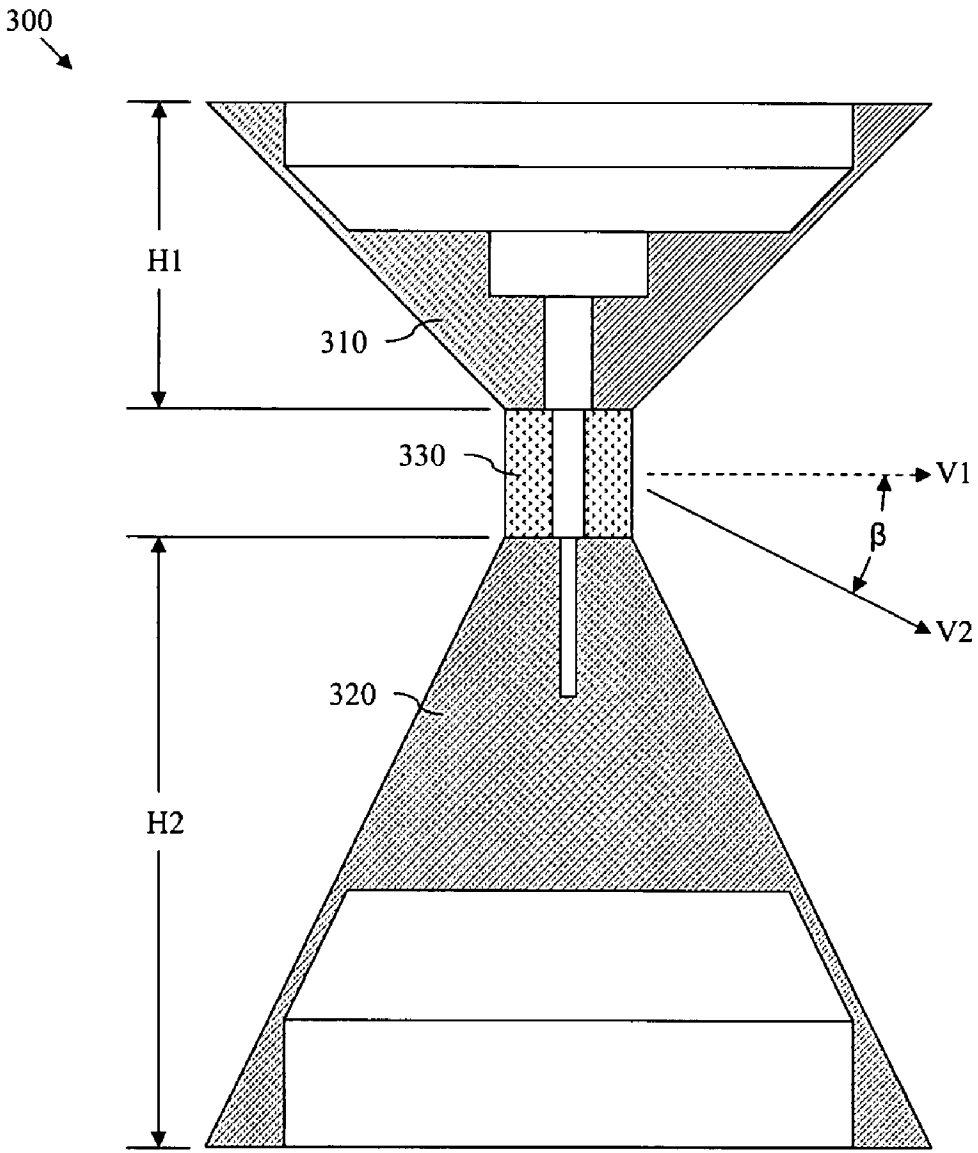
FIG. 11 is a sectional view of at least a portion of an apparatus demonstrating aspects of the present disclosure.

Referring to FIG. 11, illustrated is a sectional view of a portion of another example of the apparatus 100 shown in FIG. 7, herein designated by the reference numeral 300. The apparatus 300 is substantially similar to the apparatus 100 with the following possible exceptions.

The apparatus 300 includes radiating elements 310 and 320 which are substantially similar to the radiating elements 110 and 120, respectively, shown in FIG. 7. However, whereas the radiating elements 110 and 120 of FIG. 7 may have substantially similar heights, the height H1 of the radiating element 310 is substantially different than the height H2 of the radiating element 320. For example, as in the example depicted in FIG. 11, the height H2 of the radiating element 320 is about twice the height H1 of the radiating element 310. Of course, other values of the ratio of the heights H1 and H2 of the radiating elements 310 and 320 are also within the scope of the present disclosure, including those in which the height H1 of the radiating element 310 is larger than the height H2 of the radiating element 320.

However, in the example shown in FIG. 11, the height H2 of the radiating element 320 is substantially larger than the height H1 of the radiating element 310. Consequently, the directional vector V2 of the primary direction of signal radiation from the apparatus 300 is skewed towards the radiating element 320 by an angle β, relative to the directional vector V1 that might exist if the heights H1 and H2 of the radiating elements 310 and 320 were substantially equal. The angle β may vary up to about 40 degrees within the scope of the present disclosure. For example, the angle β may be about 30 degrees.

The apparatus 300 may also include a spacer 330 interposing and, possibly, contacting the radiating elements 310, 320. The spacer 330 may be substantially similar to the spacer 160 shown in FIGS. 7 and 8.

Figure 12:
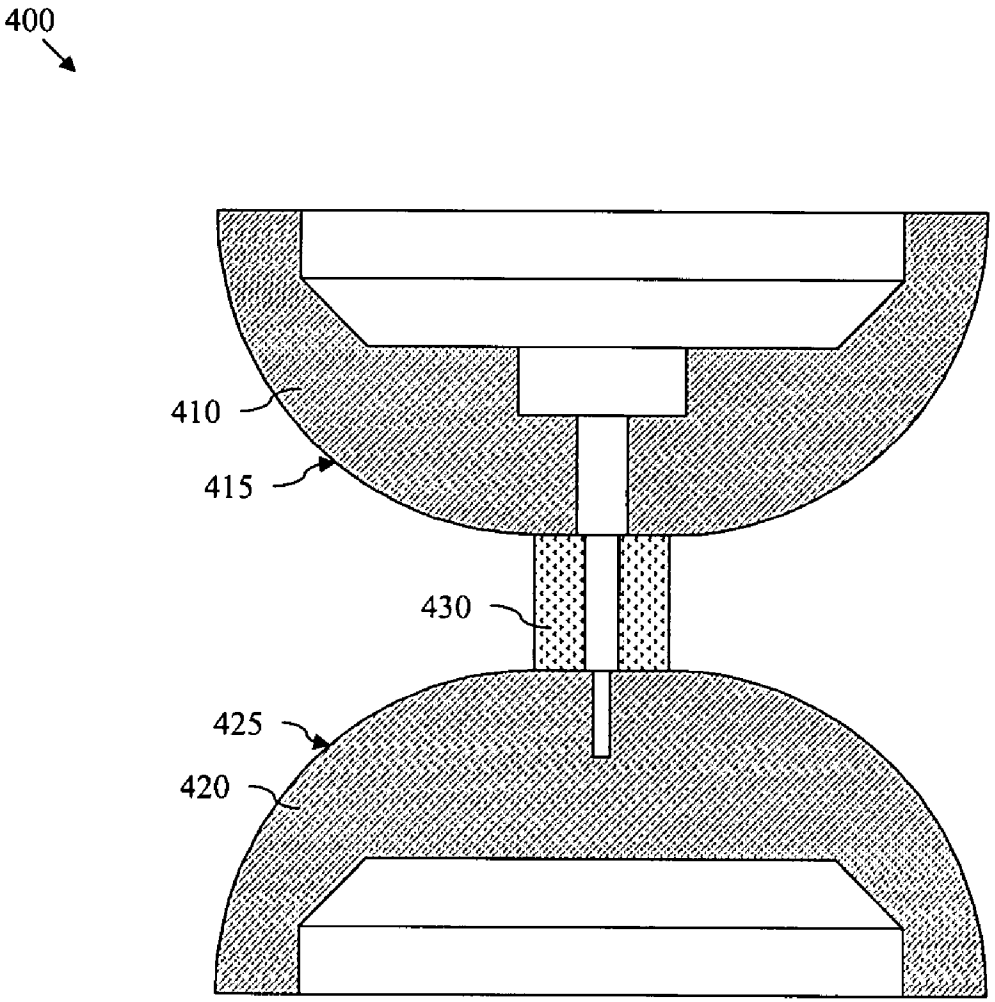
FIG. 12 is a sectional view of at least a portion of an apparatus demonstrating aspects of the present disclosure.

Referring to FIG. 12, illustrated is a sectional view of a portion of another example of the apparatus 100 shown in FIG. 7, herein designated by the reference numeral 400. The apparatus 400 is substantially similar to the apparatus 100 with the following possible exceptions.

The apparatus 400 includes radiating elements 410 and 420 which are substantially similar to the radiating elements 110 and 120, respectively, shown in FIG. 7. However, whereas the conical surfaces of the radiating elements 110 and 120 of FIG. 7 may be substantially linear, the conical surfaces 415 and 425 of the radiating elements 410 and 420, respectively, are substantially parabolic. For example, the profile of the conical surfaces 415 and/or 425 may substantially conform to the parabolic equation:

$$y=ax^2+bx+c \tag{1}$$

where "x" is the radius of the substantially parabolic conical surface at an axial position "y" and each of "a," "b" and "c" are real numbers. Moreover, the conical surfaces 415 and 425 of the radiating elements 410 and 420, respectively, may conform to different equations (e.g., different values of "a," "b" and/or "c" may be applicable to conical surface 425 relative to conical surface 415).

The apparatus 400 may also include a spacer 430 interposing and, possibly, contacting the radiating elements 410, 420. The spacer 430 may be substantially similar to the spacer 160 shown in FIGS. 7 and 8.

Figure 13:
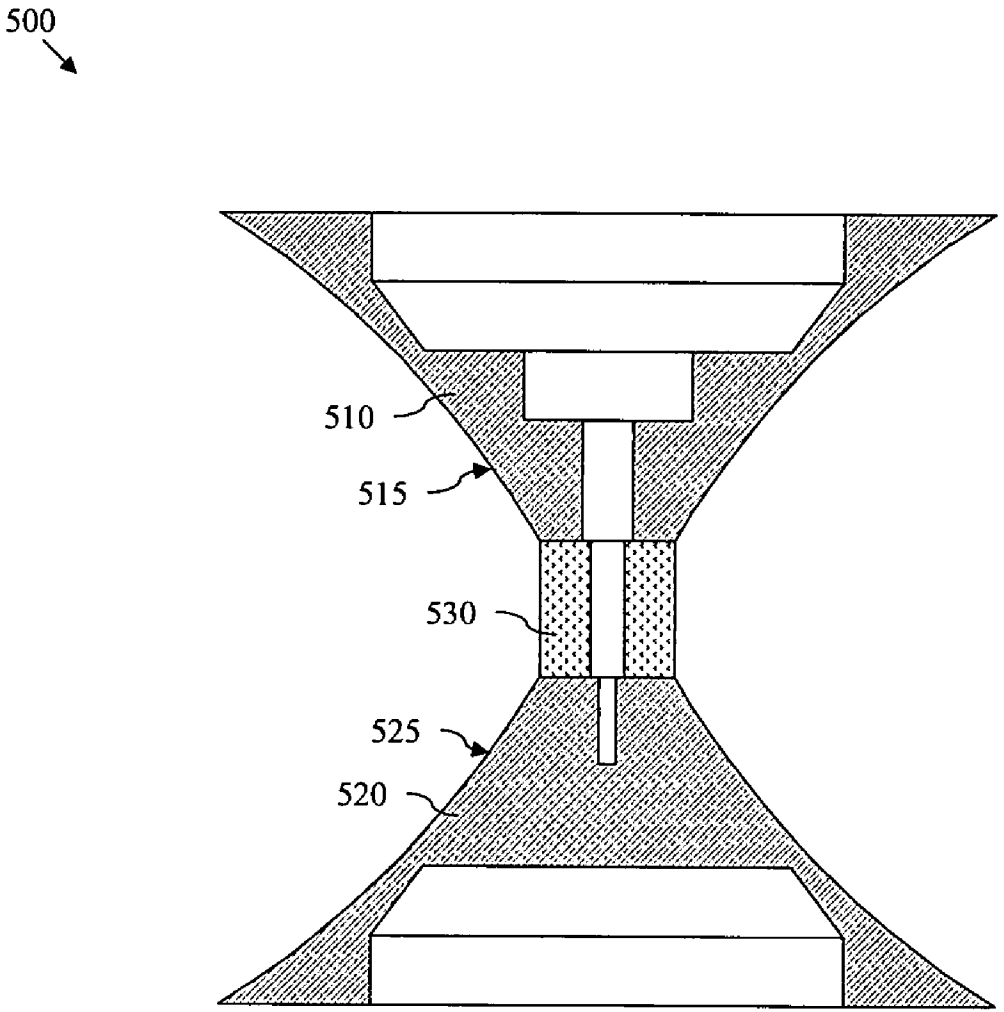
FIG. 13 is a sectional view of at least a portion of an apparatus demonstrating aspects of the present disclosure.

Referring to FIG. 13, illustrated is a sectional view of a portion of another example of the apparatus 100 shown in FIG. 7, herein designated by the reference numeral 500. The apparatus 500 is substantially similar to the apparatus 100 with the following possible exceptions.

The apparatus 500 includes radiating elements 510 and 520 which are substantially similar to the radiating elements 110 and 120, respectively, shown in FIG. 7. However, whereas the conical surfaces of the radiating elements 110 and 120 of FIG. 7 may be substantially linear, the conical surfaces 515 and 525 of the radiating elements 510 and 520, respectively, are substantially hyperbolic. For example, the profile of the conical surfaces 515 and/or 525 may substantially conform to the hyperbolic equation:

$$[(x-h)^2]/a^2-[(y-k)^2]/b^2=1 \tag{2}$$

where "x" is the radius of the substantially parabolic conical surface at an axial position "y" and each of "a," "b," "h" and "k" are real numbers. Moreover, the conical surfaces 515 and 525 of the radiating elements 510 and 520, respectively, may conform to different equations (e.g., different values of "a," "b," "h" and/or "k" may be applicable to conical surface 525 relative to conical surface 515).

The apparatus 500 may also include a spacer 530 interposing and, possibly, contacting the radiating elements 510, 520. The spacer 530 may be substantially similar to the spacer 160 shown in FIGS. 7 and 8.

Figure 14:
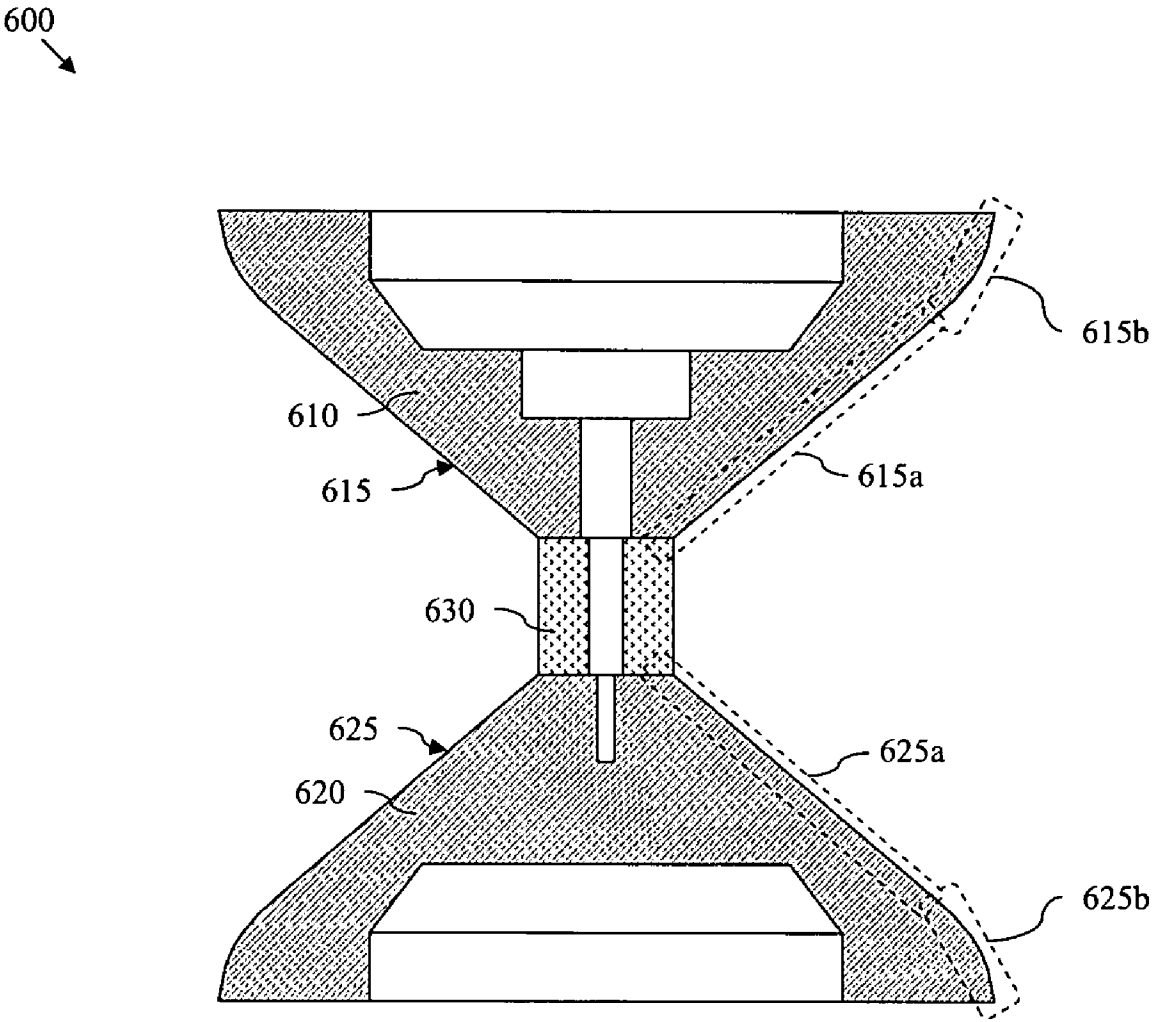
FIG. 14 is a sectional view of at least a portion of an apparatus demonstrating aspects of the present disclosure.

Referring to FIG. 14, illustrated is a sectional view of a portion of another example of the apparatus 100 shown in FIG. 7, herein designated by the reference numeral 600. The apparatus 600 is substantially similar to the apparatus 100 with the following possible exceptions.

The apparatus 600 includes radiating elements 610 and 620 which are substantially similar to the radiating elements 110 and 120, respectively, shown in FIG. 7. However, whereas the conical surfaces of the radiating elements 110 and 120 of FIG. 7 may be substantially linear, the conical surfaces 615 and 625 of the radiating elements 610 and 620, respectively, are compound surfaces. For example, first portions 615*a* and 625*a* of the profiles of the conical surfaces 615 and/or 625 may be substantially linearly conical, whereas second portions 615*b* and 625*b* of the profiles of the conical surfaces 615 and/or 625 may be substantially non-linearly conical. The second, non-linearly conical portions 615*b* and 625*b* of the conical surfaces 615 and 625 may have a substantially constant radius, or they may substantially confirm to Equations (1) or (2) set forth above.

Of course, the variation of the conical surfaces 615 and 625 may vary within the scope of the present disclosure. For example, one or each of the conical surfaces 615 and 625 may include more than two different profiles, any of which may be substantially linear, substantially parabolic, substantially hyperbolic, or of substantially constant radius.

The apparatus 600 may also include a spacer 630 interposing and, possibly, contacting the radiating elements 610, 620. The spacer 630 may be substantially similar to the spacer 160 shown in FIGS. 7 and 8.

Figure 15:
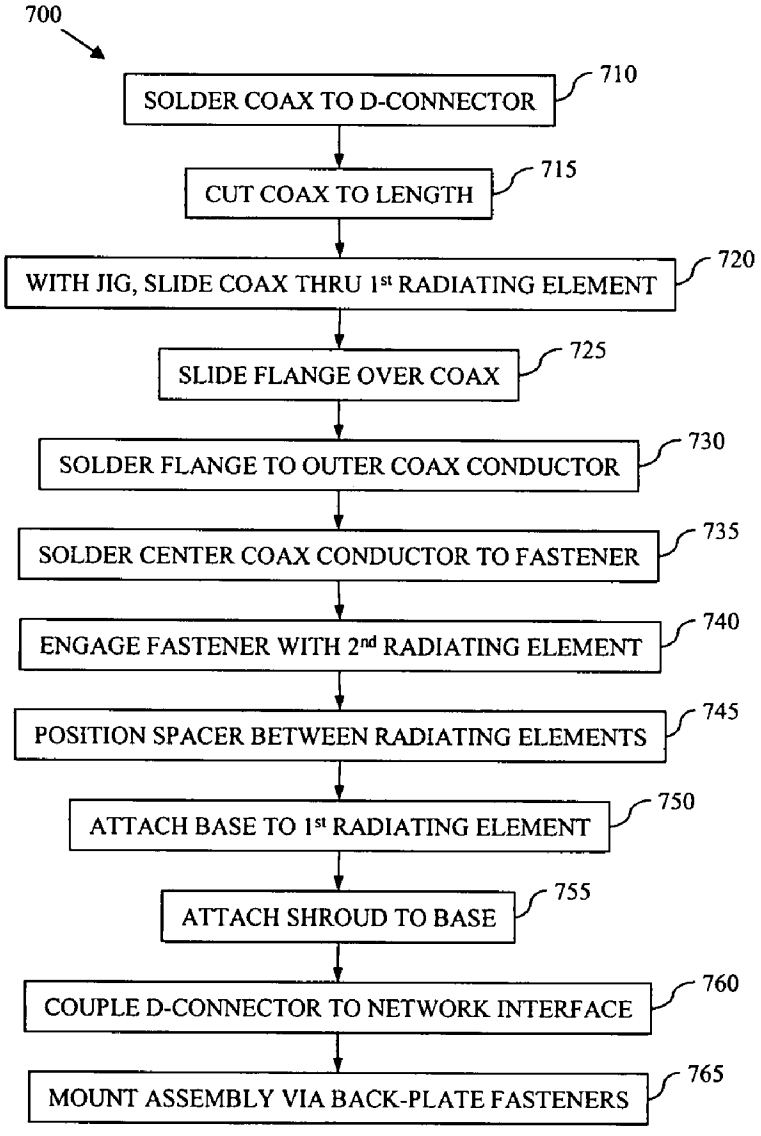
FIG. 15 is a flow-chart diagram of at least a portion of a method of manufacture demonstrating aspects of the present disclosure.

Referring to FIG. 15, illustrated is a flow-chart diagram of at least a portion of an example manufacturing method 700 according to aspects of the present disclosure. The method 700 includes a soldering step 710 during which a signal cable or other signal feed may be mechanically and/or electrically coupled to a D-connector or other coaxial connector. As in the examples described above, the signal feed may be or comprise a coaxial cable. The signal feed may then be cut to a predetermined length during a step 715, although step 715

(among other steps of method 700) may be performed elsewhere in the sequence of steps performed during execution of method 700.

Possibly employing an assembly jig, the signal feed may then be positioned relative to a first radiating element in step 720, such as by sliding the signal feed through a through-hole of the first radiating element. In subsequent step 725, a flange may also be positioned relative to the first radiating element and/or the signal feed, such as by sliding the flange over the signal feed, perhaps until the flange engages or otherwise mates with the first radiating element. The flange may then be soldered or otherwise coupled to the first radiating element in step 730. This step 730 may also (or alternatively) include soldering or otherwise coupling the flange to the outer conductor of the signal feed, such as where the signal feed may be or comprise a coaxial cable having inner and outer conductors separated by an insulator.

In another step 735, and continuing with the coaxial signal feed example, the inner conductor of the signal feed may then be soldered or otherwise coupled to a threaded fastener or other means configured to mechanically and electrically engage with a second radiating element. Thereafter, in step 740, the threaded fastener or other attachment means may be coupled to the second radiating element, such as by tightening the threaded fastener, although soldering or other adhesive means may also be employed. This step 740 may employ a jig to, for example, accurately position the launch point of the signal feed relative to the first and second radiating elements. A spacer may then be positioned between the first and second radiating elements during step 745, although the spacer may alternatively be positioned prior to coupling the inner conductor attachments means to the second radiating element.

A base may then be attached to the first radiating element in step 750, and a shroud may then be attached to the base and/or the second radiating element in step 755. The D-connector may then be attached to a network interface in step 760, such as a coaxial cable of the network. In step 765, the completed assembly, including the base, the shroud, and both radiating elements, may then be mounted to the physical structure of the network (e.g., office building structure) via threaded fasteners or other attachment means, which possibly extend from the base as in the examples described above.

Figure 16:
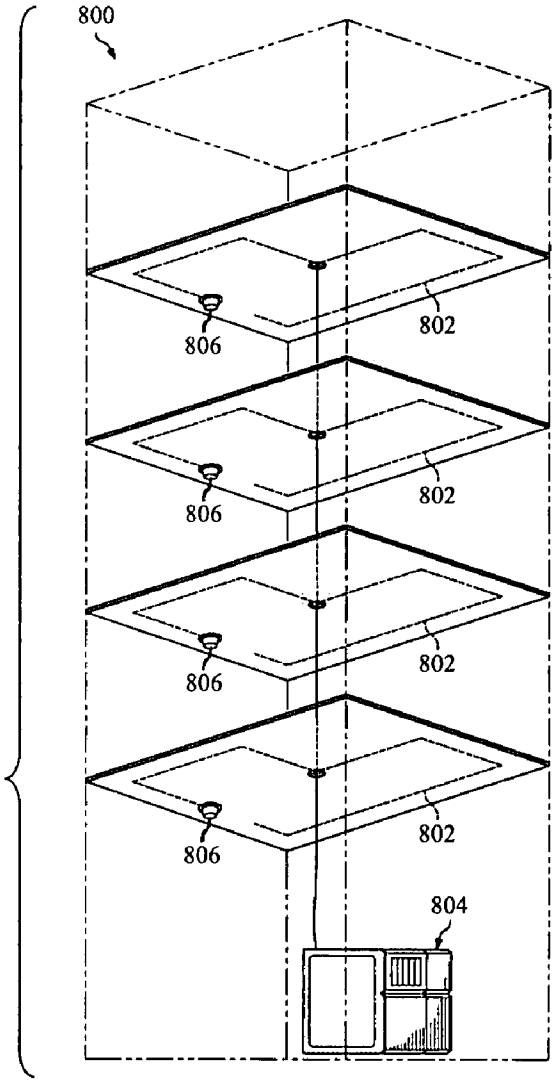
FIG. 16 is a schematic diagram of at least a portion of apparatus demonstrating aspects of the present disclosure.

Referring to FIG. 16, one example of an environment 800 is illustrated within which one or more antennas 806 (e.g., one of the above-described radiating apparatus or assemblies thereof) may be employed. The environment 800 includes a multi-story building having a plurality of antennas (e.g., the apparatus 200 of FIGS. 9A and 9B or the apparatus 202 of FIG. 10, among others) connected to radiating coaxial cables 802. The cables 802 extend into a telecom room 804 that provides connection to various external systems and networks (not shown), such as the internet. It is understood that the environment 800 is merely one example of an environment that may utilize the apparatus described in the present disclosure, and that many other environments are envisioned.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The present disclosure introduces an antenna that comprises, for example, a first radiating element having a first substantially conical radiating surface, and a second radiating element having a second substantially conical radiating surface, wherein the first and second radiating surfaces are substantially aligned coaxially, and wherein the first and second radiating elements extend in opposing directions on opposing sides of a signal launching region. A signal feed extends through the first radiating element and positions a signal launch point between the first and second radiating elements in the signal launching region proximate vertices of the first and second radiating surfaces. The first and second radiating elements have first and second included angles, respectively, that are each no less than about 75 degrees.

The present disclosure also introduces a method that comprises, for example, coupling a signal cable to a feedthrough connector, wherein the signal cable includes an inner conductor, an insulator forming an annulus substantially coaxially around the inner conductor, and an outer conductor forming an annulus substantially coaxially around the insulator. The signal cable is inserted through a first radiating element, wherein the first radiating element includes a substantially conical radiating surface having a first included angle of no less than about 75 degrees. The outer conductor is coupled to the first radiating element proximate a first vertex of the first radiating surface, and the inner conductor is coupled to a second vertex of a second radiating surface of a second radiating element, wherein the second radiating surface is substantially conical and has a second included angle of no less than about 75 degrees.

The present disclosure also introduces an antenna comprising, for example, a first radiating element having a first radiating surface that is nonlinearly conical, and a second radiating element having a second radiating surface that is nonlinearly conical, wherein the first and second radiating surfaces are substantially aligned coaxially, and wherein the first and second radiating elements extend in opposing directions on opposing sides of a signal launching region. A signal feed extends through the first radiating element and positions a signal launch point between the first and second radiating elements in the signal launching region proximate vertices of the first and second radiating surfaces. The first and second radiating elements have first and second average included angles, respectively, that are each no less than about 75 degrees.

What is claimed is:

1. An antenna, comprising:

a first radiating element having a first substantially conical radiating surface;

a second radiating element having a second substantially conical radiating surface, wherein the first and second radiating surfaces are substantially aligned coaxially, and wherein the first and second radiating elements extend in opposing directions on opposing sides of a signal launching region;

a signal feed extending through the first radiating element and positioning a signal launch point between the first and second radiating elements in the signal launching region proximate vertices of the first and second radiating surfaces;

a base; and a shroud;

wherein the first and second radiating elements have first and second included angles, respectively, that are each no less than about 75 degrees;

wherein the base is directly coupled to the first radiating element and the shroud; and wherein the shroud envelopes the first and second radiating elements.

2. The apparatus of claim 1 wherein the first and second included angles are each between about 75 degrees and about 120 degrees.

3. The apparatus of claim 1 wherein the first and second included angles are each about 84 degrees.

4. The apparatus of claim 1 wherein the first included angle is substantially different relative to the second included angle.

5. The apparatus of claim 1 further comprising a non-magnetic spacer interposing and contacting each of the first and second radiating elements, wherein the spacer is substantially RF-transparent.

6. The apparatus of claim 1 further comprising a plastic spacer interposing and contacting each of the first and second radiating elements, wherein the spacer is substantially RF-transparent.

7. The apparatus of claim 1 wherein the first radiating element has a first height and the second radiating element has a second height that is substantially different relative to the first height.

8. The apparatus of claim 1 wherein the first and second radiating elements are each partially hollow.

9. The apparatus of claim 1 further comprising:

a feedthrough connector coupled to the base and the signal feed and having anti-rotation keyed flats captured by corresponding features of the base.

10. A method, comprising:

coupling a signal cable to a feedthrough connector, wherein the signal cable includes an inner conductor, an insulator forming an annulus substantially coaxially around the inner conductor, and an outer conductor forming an annulus substantially coaxially around the insulator;

inserting the signal cable through a first radiating element, wherein the first radiating element includes a substantially conical radiating surface having a first included angle of no less than about 75 degrees;

coupling the outer conductor to the first radiating element proximate a first vertex of the first radiating surface;

coupling the inner conductor to a second vertex of a second radiating surface of a second radiating element, wherein the second radiating surface is substantially conical and has a second included angle of no less than about 75 degrees;

after coupling the inner conductor to the second radiating element, coupling a base to the feedthrough connector and the first radiating element such that rotation of the base relative to either of the feedthrough connector and the first radiating element is substantially prevented; and after coupling the base to the feedthrough connector and the first radiating element, coupling a shroud to the base, wherein the shroud and base collectively enclose the first and second radiating elements.

11. The method of claim 10 wherein each of the first and second included angles is between about 75 degrees and about 120 degrees.

12. The method of claim 10 wherein each of the first and second included angles is about 84 degrees.

13. The method of claim 10 wherein the first included angle is substantially different relative to the second included angle.

14. The method of claim 10 wherein a first height of the first radiating element is substantially different relative to a second height of the second radiating element.

15. The method of claim 10 wherein coupling the outer conductor to the first radiating element includes soldering the outer conductor to the first radiating element, and wherein coupling the inner conductor to the second radiating element includes soldering the inner conductor to the second radiating element.

16. The method of claim 10 wherein coupling the outer conductor to the first radiating element includes coupling the outer conductor to an interposing member and coupling the interposing member to the first radiating element.

17. The method of claim 10 wherein coupling the outer conductor to the first radiating element includes soldering the outer conductor to a flange and mechanically fastening the flange to the first radiating element with at least one threaded fastener.

18. The method of claim 10 wherein coupling the inner conductor to the second radiating element includes coupling the inner conductor to an interposing member and coupling the interposing member to the second radiating element.

19. The method of claim 10 wherein coupling the inner conductor to the second radiating element includes soldering the inner conductor to a threaded fastener and mechanically fastening the threaded fastener to the second radiating element with at least one threaded fastener.

20. The method of claim 10 further comprising assembling a spacer between the first and second radiating elements after coupling the inner conductor to the second radiating element, wherein at least a portion of the signal cable extends through a central opening of the spacer.

21. The method of claim 20 wherein the spacer has a substantially RF-transparent composition.

22. The method of claim 20 wherein the spacer substantially comprises a substantially RF-transparent plastic.

23. The method of claim 10 wherein coupling the inner conductor to the second radiating element includes maintaining a predetermined spacing between the first and second radiating elements while coupling the inner conductor to the second radiating element.

24. The method of claim 10 wherein coupling the shroud to the base includes engaging the second radiating element with the shroud.

* * * * *